US007644517B2

(12) United States Patent
Gerber

(10) Patent No.: US 7,644,517 B2
(45) Date of Patent: Jan. 12, 2010

(54) MODULAR ARTICLE OF FOOTWEAR

(75) Inventor: Marni L. Gerber, West Linn, OR (US)

(73) Assignee: Nike, Inc., Beaverton, OR (US)

( * ) Notice: Subject to any disclaimer, the term of this patent is extended or adjusted under 35 U.S.C. 154(b) by 559 days.

(21) Appl. No.: 11/455,271

(22) Filed: Jun. 16, 2006

(65) Prior Publication Data

US 2007/0289161 A1 Dec. 20, 2007

(51) Int. Cl.
*A43B 3/12* (2006.01)
*A43B 3/24* (2006.01)

(52) U.S. Cl. ..... 36/11.5; 36/101; 36/100

(58) Field of Classification Search ..... 36/11.5, 36/101, 100, 15, 7.4, 7.5, 7.6, 58.6, 62, 72 B, 36/97

See application file for complete search history.

(56) References Cited

U.S. PATENT DOCUMENTS 3,530,596 A * 9/1970 Misteli et al. ..... 36/99
4,267,650 A * 5/1981 Bauer ..... 36/101
4,727,659 A * 3/1988 Walker ..... 36/72 B
5,410,821 A * 5/1995 Hilgendorf ..... 36/100
5,669,160 A * 9/1997 Pozzebon ..... 36/10
5,893,222 A * 4/1999 Donnelly ..... 36/117.6
2003/0097770 A1 * 5/2003 Karasawa ..... 36/97
2004/0128863 A1 7/2004 Hong et al.
2004/0255486 A1 12/2004 Pawlus et al.
2005/0076539 A1 4/2005 Klein

FOREIGN PATENT DOCUMENTS

GB 2376640 12/2002
WO 2004026062 4/2004

OTHER PUBLICATIONS

PCT/US2007/013262, International Search Report, dated Nov. 19, 2008.
PCT/US2007/013262, Written Opinion, dated Nov. 19, 2008.
PCT/US2007/013262, International Preliminary Report On Patentability, dated Dec. 16, 2008.

* cited by examiner

*Primary Examiner*—Ted Kavanaugh
(74) *Attorney, Agent, or Firm*—Banner & Witcoff, Ltd.

(57) ABSTRACT

An article of footwear includes an upper and a sole structure and at least two elements that join to form the upper and the sole structure. The elements each form a portion of the upper and a portion of the sole structure. With regard to the upper, the elements each form a strap portion that, in combination, secures a foot to the footwear. With regard to the sole structure, the elements each form a portion of the foot-supporting surface and the ground-engaging surface. The elements may be joined through a snap-fit system involving protrusions and apertures, or adhesives may be used.

24 Claims, 16 Drawing Sheets

MODULAR ARTICLE OF FOOTWEAR

BACKGROUND

Conventional articles of footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces, the sole structure may provide traction and control foot motion, such as over pronation. Accordingly, the upper and the sole structure operate cooperatively to provide a comfortable structure that is suited for a wide variety of ambulatory activities, such as walking and running.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. This general structure for the upper may vary depending upon the type of footwear. For example, the upper of a sandal may only cover a portion of the foot, and the upper of a boot may extend upward to cover a portion of the ankle. Various materials may be utilized in manufacturing the upper. The upper of an article of athletic footwear, for example, may be formed from multiple material layers that include an exterior layer, a middle layer, and an interior layer that are formed from one or more of leather, synthetic leather, textiles, polymer sheets, mesh materials, and foam, for example. In order to join the layers and form the upper, adhesives, stitching, or a combination of adhesives and stitching may be utilized.

The sole structure generally incorporates multiple layers that are conventionally referred to as an insole, a midsole, and an outsole. The insole is a thin, cushioning member located within the upper and adjacent the plantar (lower) surface of the foot to enhance footwear comfort. The midsole, which may be adhesively-secured or stitched to the upper, forms the middle layer of the sole structure and serves a variety of purposes that include attenuating ground reaction forces and controlling foot motions. The outsole is bonded to the midsole and forms a ground-contacting element of the footwear. The insole may be formed from textiles, polymer foam, or a combination of textiles and foam, for example. The primary material for a conventional midsole is a resilient, polymer foam material, such as polyurethane or ethylvinylacetate. In some articles of footwear, the polymer foam material may encapsulate a fluid-filled bladder or other elements. The outsole is generally formed from a rubber material with a relatively high degree of wear resistance.

Based upon the above discussion, conventional articles of footwear are formed from a variety of materials that are permanently joined with adhesives or stitching, for example. When one footwear element (e.g., upper, sole structure, midsole, outsole) becomes worn or otherwise damaged, the permanent nature of the adhesive or stitching effectively limits the ability to replace the footwear element. Accordingly, the footwear may be unusable if even one footwear element is damaged. Similarly, the variety of materials forming the various footwear elements, coupled with the permanent nature of the adhesive or stitching, effectively limits the ability to recycle the various footwear elements. Upon the expiration of the useful life of the footwear, therefore, the footwear or individual footwear elements may not generally be recycled because the various footwear elements may not be easily separated.

SUMMARY

An aspect of the invention involves an article of footwear having an upper and a sole structure. The footwear includes two joinable and detachable elements that each form a portion of the upper and the sole structure. The elements may be foam elements, or may be formed from other materials. The elements may also exhibit different colors.

In a configuration wherein the footwear is a sandal, the upper may include two strap portions, and each of the elements form one of the strap portions. A first of the strap portions may define a plurality of protrusions, and a second of the strap portions may define a plurality of apertures, with the protrusions joining with the apertures to secure the strap portions together.

The sole structure has a foot-engaging surface and an opposite ground-engaging surface, and each of the foam elements may form different areas of the foot-engaging surface and the ground-engaging surface. As with the upper, the portions of the elements forming the sole structure may define protrusions and apertures that join to secure the elements together. A portion of the protrusions and apertures may be located at a side surface of the sole structure, and another portion of the protrusions and apertures may be located at a ground-engaging surface of the sole structure.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

Figure 1:
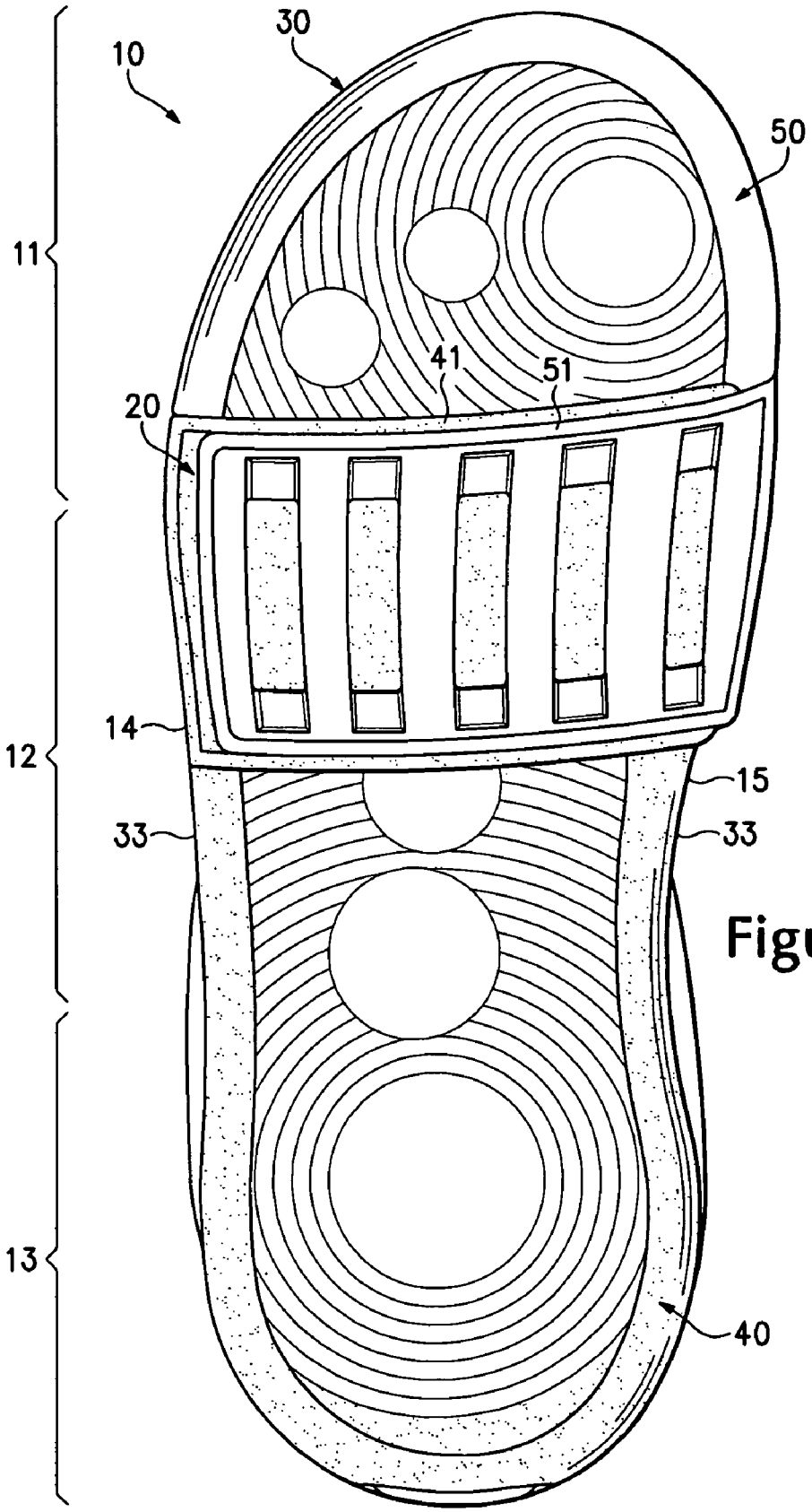
FIG. 1 is a top plan view of an article of footwear formed from a first element and a second element.

The following material and accompanying figures disclose a modular article of footwear formed from joined foam elements. The footwear is disclosed as having a configuration of a sandal. Concepts associated with the footwear are not limited solely to sandals, however, and may be applied to a wide range of footwear styles, including athletic footwear (e.g., running shoes, basketball shoes, tennis shoes) and casual footwear (e.g., dress shoes, loafers, boots), for example. An individual skilled in the relevant art will appreciate, therefore, that the concepts disclosed herein apply to a wide variety of footwear styles, in addition to the specific style discussed in the following material and depicted in the accompanying figures.

An article of footwear 10 is depicted in FIGS. 1-5E as including an upper 20 and a sole structure 30 that are each formed from both of a first element 40 and a second element 50. For reference purposes, footwear 10 may be divided into three general regions: a forefoot region 11, a midfoot region 12, and a heel region 13. Footwear 10 also includes a lateral side 14 and an opposite medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and each of elements 40 and 50.

Upper 20 has a configuration of a strap that extends over the foot, and sole structure 30 is generally positioned between the foot and the ground. The primary surfaces of sole structure 30 are a foot-supporting surface 31, an opposite ground-engaging surface 32, and a side surface 33 extending between surfaces 31 and 32. In combination, therefore, upper 20 and sole structure 30 define an area for receiving the foot between the strap of upper 20 and foot-supporting surface 31. Whereas the strap of upper 20 secures the foot to footwear 10, sole structure 30 extends under the foot to attenuate ground reaction forces (i.e., cushion the foot) during walking, running, or other ambulatory activities. Accordingly, upper 20 and sole structure 30 cooperatively provide structures that receive the foot and support the foot.

Footwear 10 is depicted in the figures as being entirely formed from elements 40 and 50, which are respectively depicted in FIGS. 6-9 and 10-13. That is, footwear 10 includes only elements 40 and 50, which may be formed from polymer foam materials that are joined through a snap-fit system described in greater detail below. In order to assist in distinguishing between elements 40 and 50 in the figures, first element 40 is depicted as having a stippled texture, whereas second element 50 does not have the stippled texture. Although footwear 10 is depicted as including only elements 40 and 50, some configurations of footwear 10 may incorporate additional components. As examples, adhesives, stitching, or other fastening devices may be utilized to join elements 40 and 50, buckles or other securing devices may be utilized in the strap of upper 20, a textile material may be bonded to foot-supporting surface 31 to enhance the comfort of footwear 10, outsole elements may be utilized on ground-contacting surface 32 to enhance the wear-resistance of footwear 10, reinforcing elements may be incorporated into areas that experience relatively high stresses, or a fluid-filled bladder may be encapsulated within sole structure 30 to enhance the ground reaction force attenuation characteristics of footwear 10.

Figure 14:
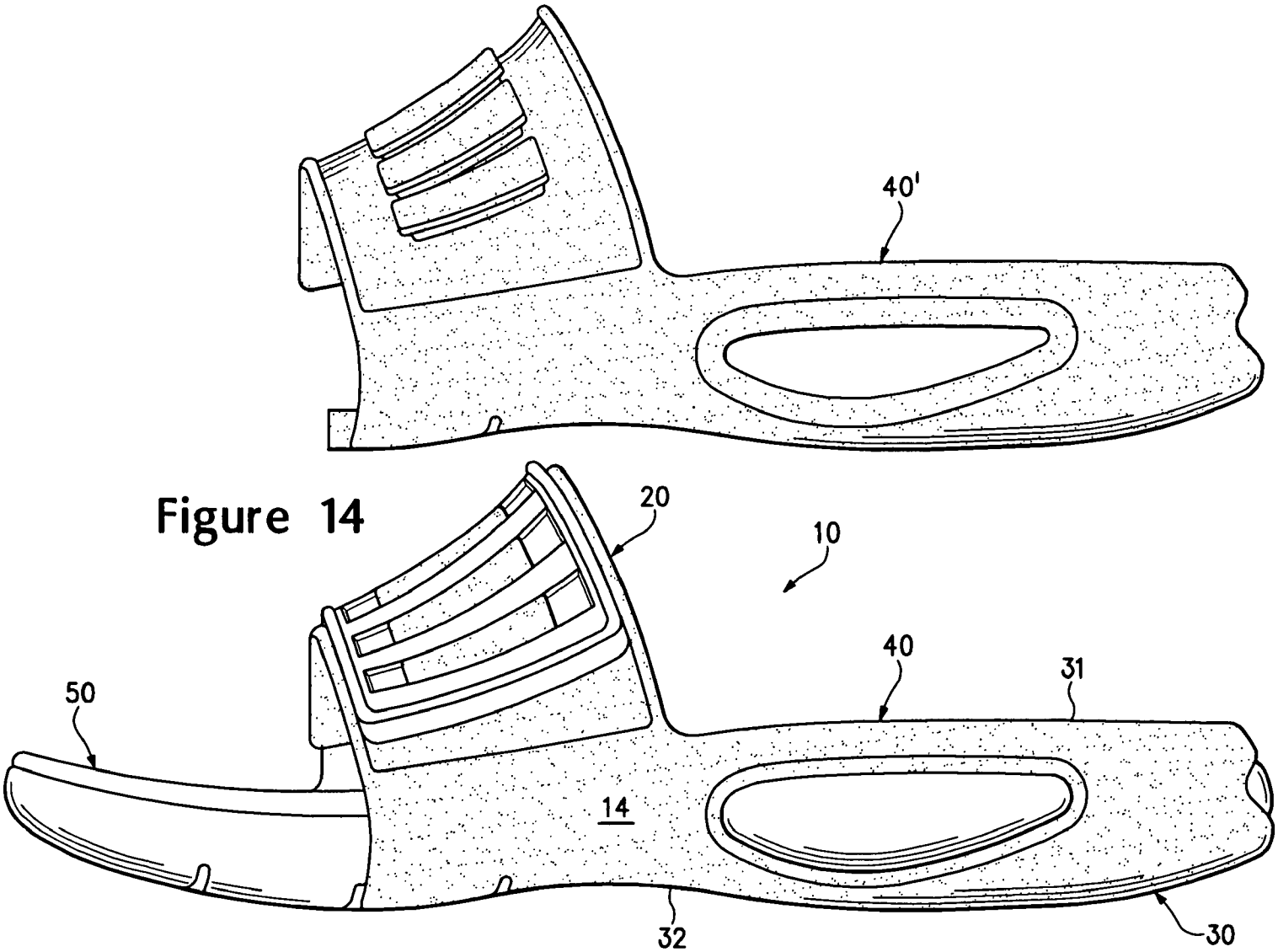
FIG. 14 is a lateral side elevational view of the footwear and a replacement element.

Although footwear 10 may incorporate the various additional components, listed above, the ability to repair footwear 10 is enhanced when footwear 10 consists of (i.e., only includes) elements 40 and 50. With reference to FIG. 14, footwear 10 is depicted with a replacement element 40' that has the general configuration of first element 40. When first element 40 becomes worn or otherwise damaged, the non-permanent nature of the snap-fit system that joins elements 40 and 50 permits first element 40 to be separated from second element 50 and replaced with replacement element 40'. That is, elements 40 and 50 may be separated such that first element 40 may be replaced with replacement element 40', thereby repairing footwear 10. Similar concepts apply when second element 50 becomes worn or otherwise damaged. Accordingly, the modular structure of footwear 10, which is due to the joinable, detachable, and replaceable properties of elements 40 and 50, permits footwear 10 to be repaired if one of elements 40 and 50 becomes damaged.

In addition to repairing footwear 10, the general system disclosed in FIG. 14 may also be utilized to modify the aesthetic characteristics or performance characteristics of footwear 10. If, for example, each of elements 40 and 50 are formed from materials with the same color, first element 40 may be replaced with replacement element 40' of a different color to modify the aesthetics of footwear 10. That is, by utilizing different elements (i.e., different combinations of elements 40, 50, and 40') with different colors, footwear 10 may be aesthetically-modified to have different color combinations that are selected by the wearer. The different color combinations may be used, for example, to coordinate the colors of footwear 10 with other apparel or show support for a particular athletic team.

Replacing first element 40 with replacement element 40' may also affect the performance characteristics of footwear 10. For example, first element 40 may be replaced with replacement element 40' to modify the pronation control, stability, and ground reaction force attenuation characteristics of footwear 10. That is, the user may select a replacement element 40' with the desired characteristics and then incorporate that replacement element 40' into footwear 10 to impart the desired performance characteristics. Accordingly, the modular structure of footwear 10 permits the user to customize various properties associated with the footwear.

In addition to user customization, the modular structure of footwear 10 permits customization during the manufacturing process. For example, if a user desires footwear 10 to have specific aesthetic characteristics and specific performance characteristics, a manufacturer may select elements 40 and 50 to achieve the aesthetic and performance characteristics desired by the user. That is, footwear 10 may be custom-manufactured to incorporate aesthetic and performance characteristics desired by the user. As another example, a plurality of pairs of footwear 10 may be custom-manufactured to have aesthetic and performance characteristics desired by a team, and each of the pairs of footwear 10 may be differently-sized for individuals on the team. By selecting elements 40 and 50 to have a variety of sizes with common aesthetic and performance characteristics, an athletic team may have custom-manufactured footwear that accommodates individuals with different foot sizes. Accordingly, the modular structure of footwear 10 permits both the user and the manufacturer to customize footwear 10 to achieve a desired combination of properties.

The absence of a variety of materials in footwear 10 also facilitates the recycling of footwear 10, or at least contributes to the efficiency with which footwear 10 or components thereof may be recycled. Upon the expiration of the useful life of footwear 10, elements 40 and 50 may be recycled due to the absence of a variety of materials in footwear 10. That is, elements 40 and 50 are formed from a polymer foam material, for example, that does not include additional components (e.g., textiles, stability devices, buckles) that are permanently attached to elements 40 and 50. Even when elements 40 and 50 are formed from different materials, the snap-fit system that joins elements 40 and 50 permits elements 40 and 50 to be separated and separately recycled. Accordingly, another advantage of forming footwear 10 from only elements 40 and 50 and to have a modular configuration includes the ability to recycle footwear 10 in a relatively efficient manner.

Elements 40 and 50 each form a portion of upper 20 and sole structure 30. That is, first element 40 forms a portion of upper 20 and also forms a portion of sole structure 30, and second element 50 forms a portion of upper 20 and also forms a portion of sole structure 30. In general, elements 40 and 50 individually form approximately one-half of footwear 10 and together form the entirety of footwear 10. Although the relative proportions of elements 40 and 50 may vary in different configurations of footwear 10, each of elements 40 and 50 form approximately one-half of upper 20 and also form approximately one-half of sole structure 30 in the configuration depicted in the figures. In combination, therefore, elements 40 and 50 form the entirety of upper 20 and sole structure 30. In other configurations of footwear 10 (i.e., where one or more of the additional components discussed above are present), elements 40 and 50 may form less than the entirety of upper 20 and sole structure 30.

With regard to the strap of upper 20, first element 40 forms a first strap portion 41 and second element 50 forms a second strap portion 51. Whereas first strap portion 41 extends upward from lateral side 14, second strap portion 51 extends upward from medial side 15 (i.e., from an opposite side of footwear 10). Each of strap portions 41 and 51 exhibit a curved and overlapping configuration that extends over the foot when footwear 10 is worn. An upper surface of first strap portion 41 defines a plurality of protrusions 42, and second strap portion 51 defines a plurality of corresponding apertures 52. When second strap portion 51 overlaps first strap portion 41, some or all of protrusions 42 may extend into apertures 52 to join strap portions 41 and 51, as depicted in the cross-sections of FIGS. 5A and 5E. By modifying the specific apertures 52 that protrusions 42 extend into, the effective length of the strap formed by strap portions 41 and 51 may be modified to accommodate feet with different proportions. That is, protrusions 42 and apertures 52 provide a snap-fit adjustment system for modifying the length of the strap of upper 20. In further configurations of footwear 10, different adjustment systems involving snaps, a buckle, or a magnetic fastener, for example, may be utilized. In some configurations, upper 20 may also be non-adjustable.

Figure 5A:
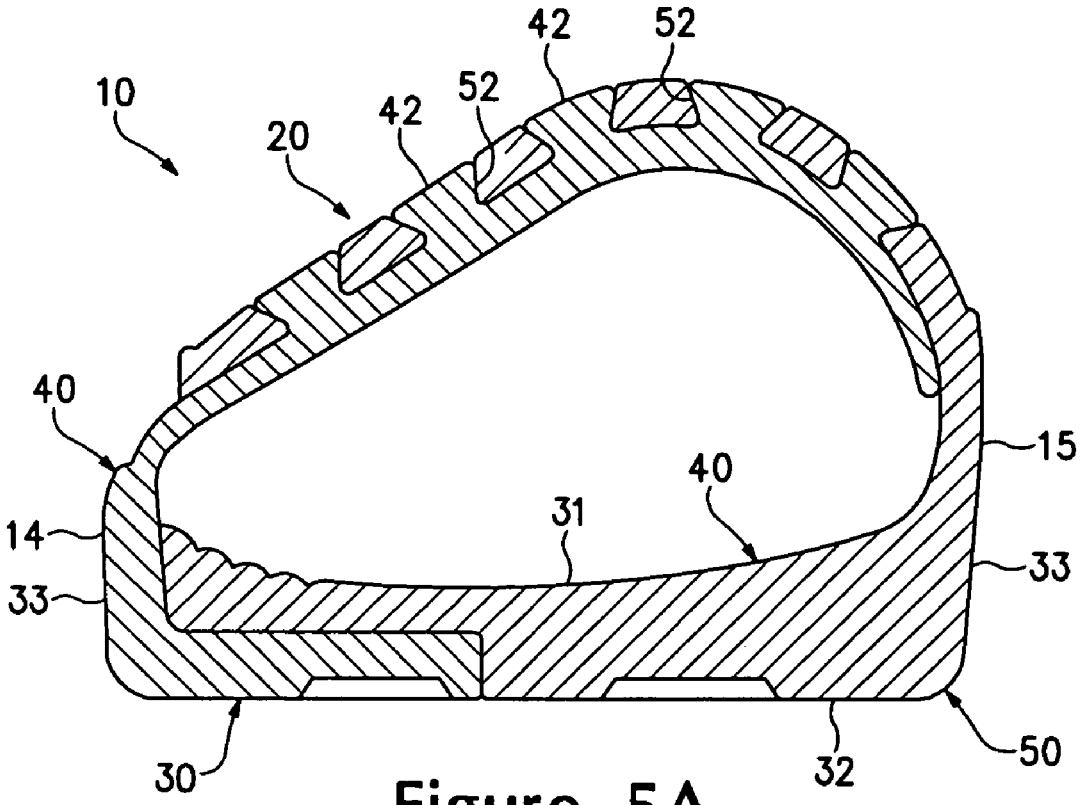
FIGS. 5A-5E are cross-sectional views of the footwear, as defined by section lines 5A-5E in FIG. 4.
Figure 5B:
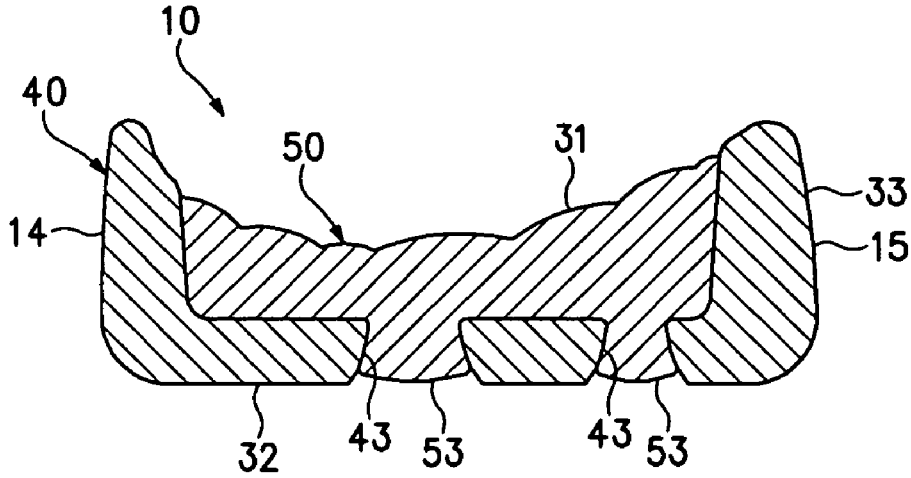
Figure 5C:
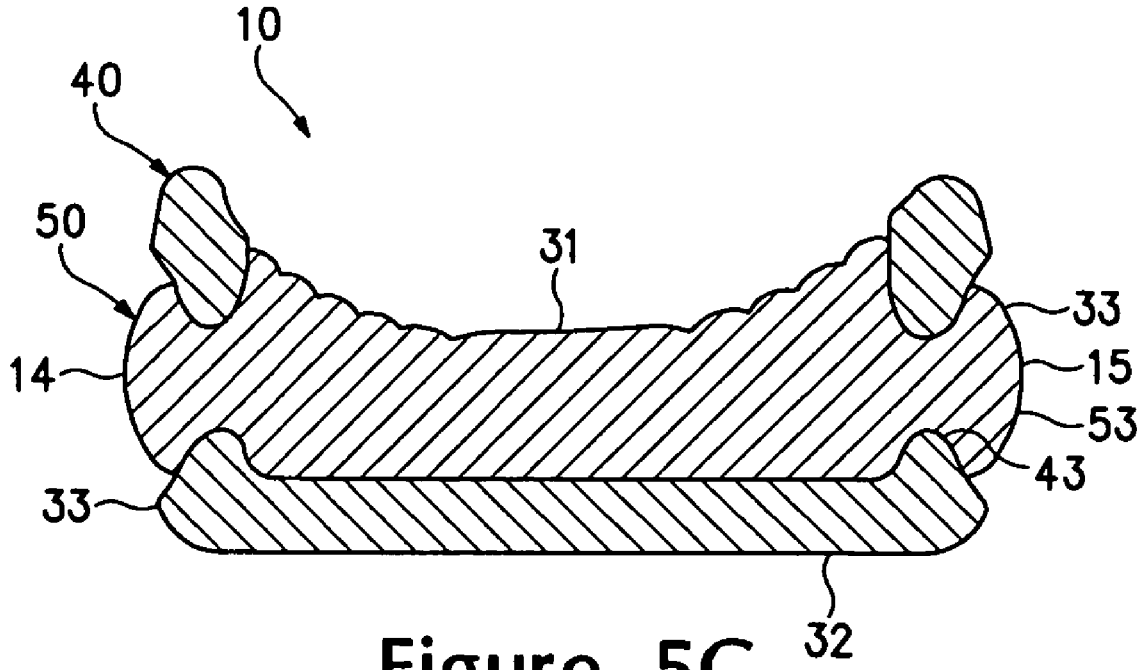
Figure 5D:
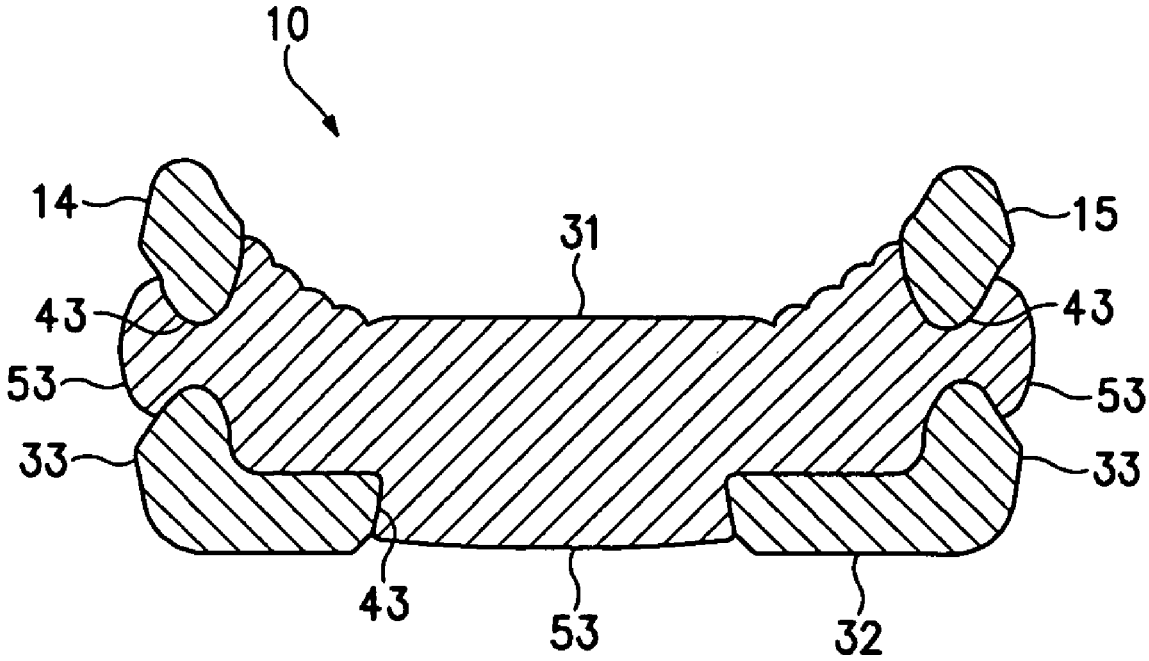
Figure 5E:
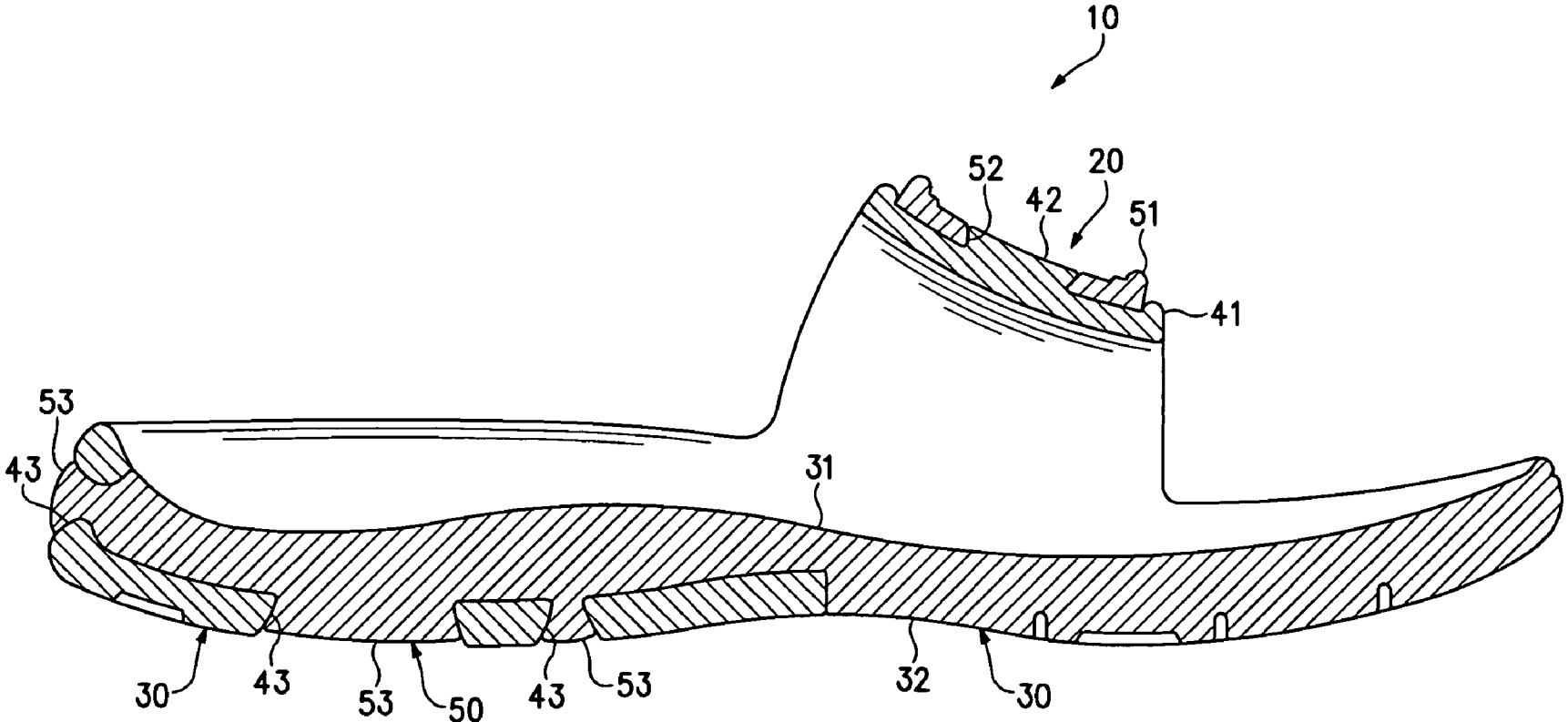
Figure 6:
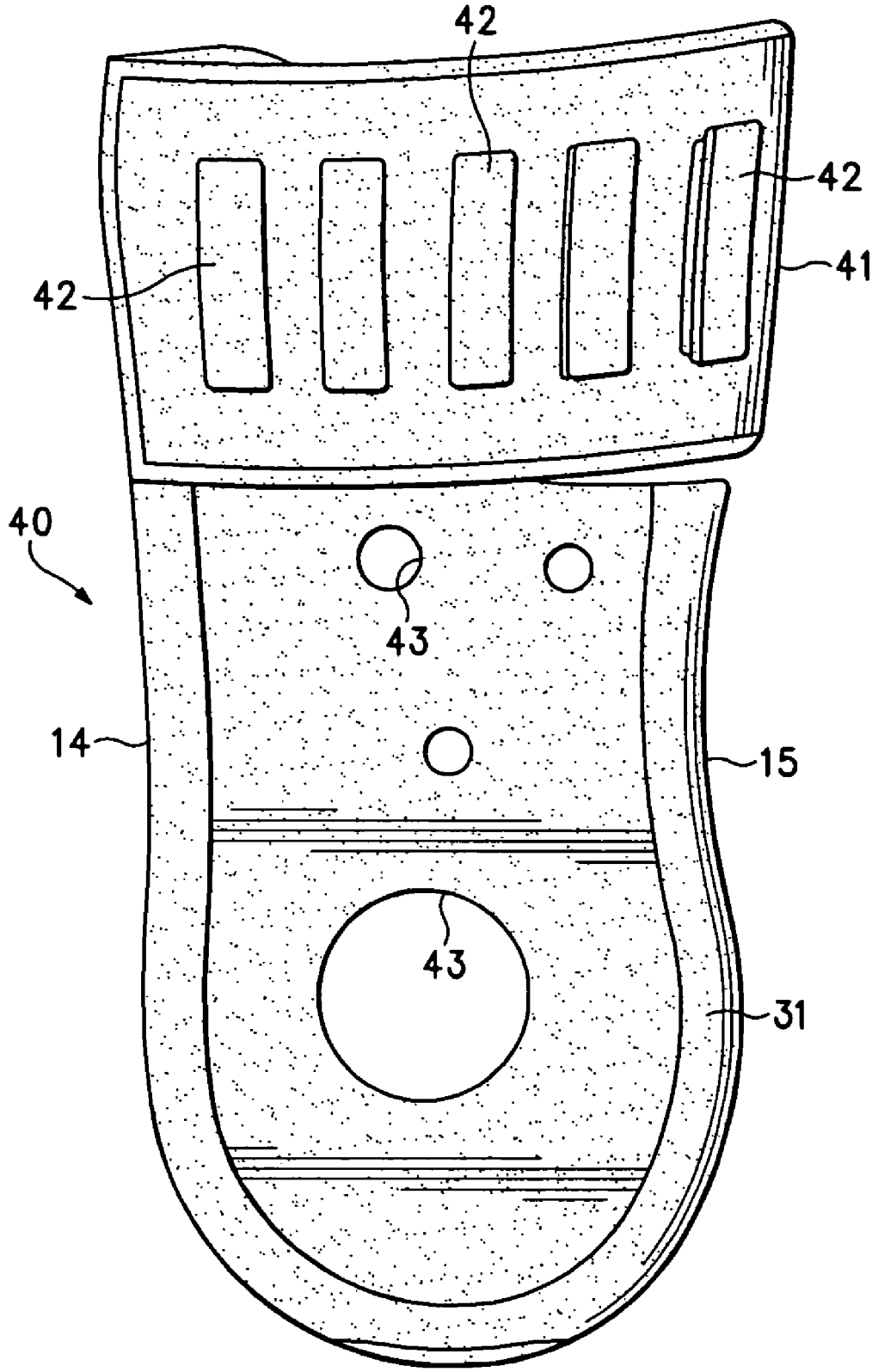
FIG. 6 is a top plan view of the first element.
Figure 7:
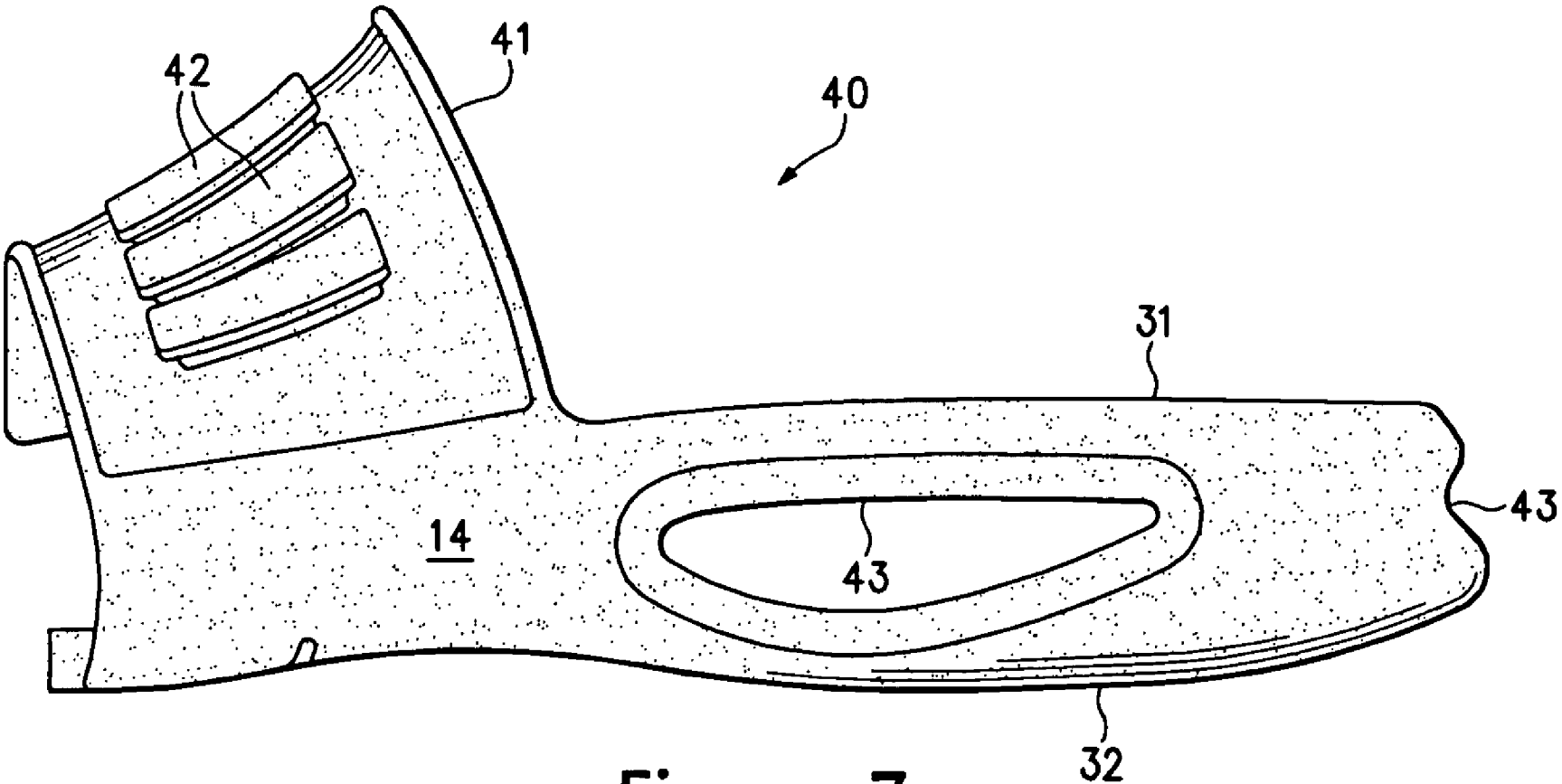
FIG. 7 is a lateral side elevational view of the first element.
Figure 8:
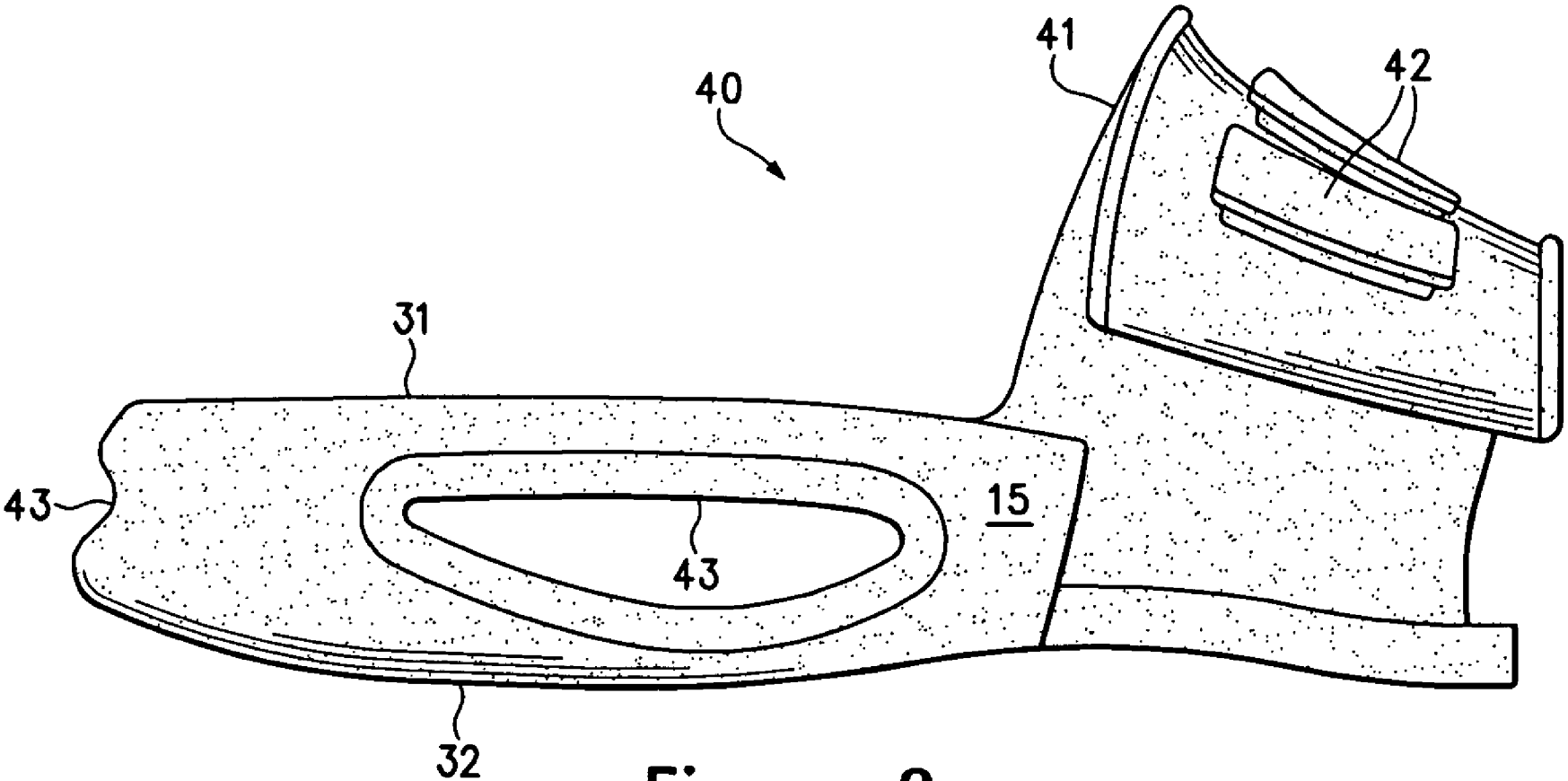
FIG. 8 is a medial side elevational view of the first element.
Figure 9:
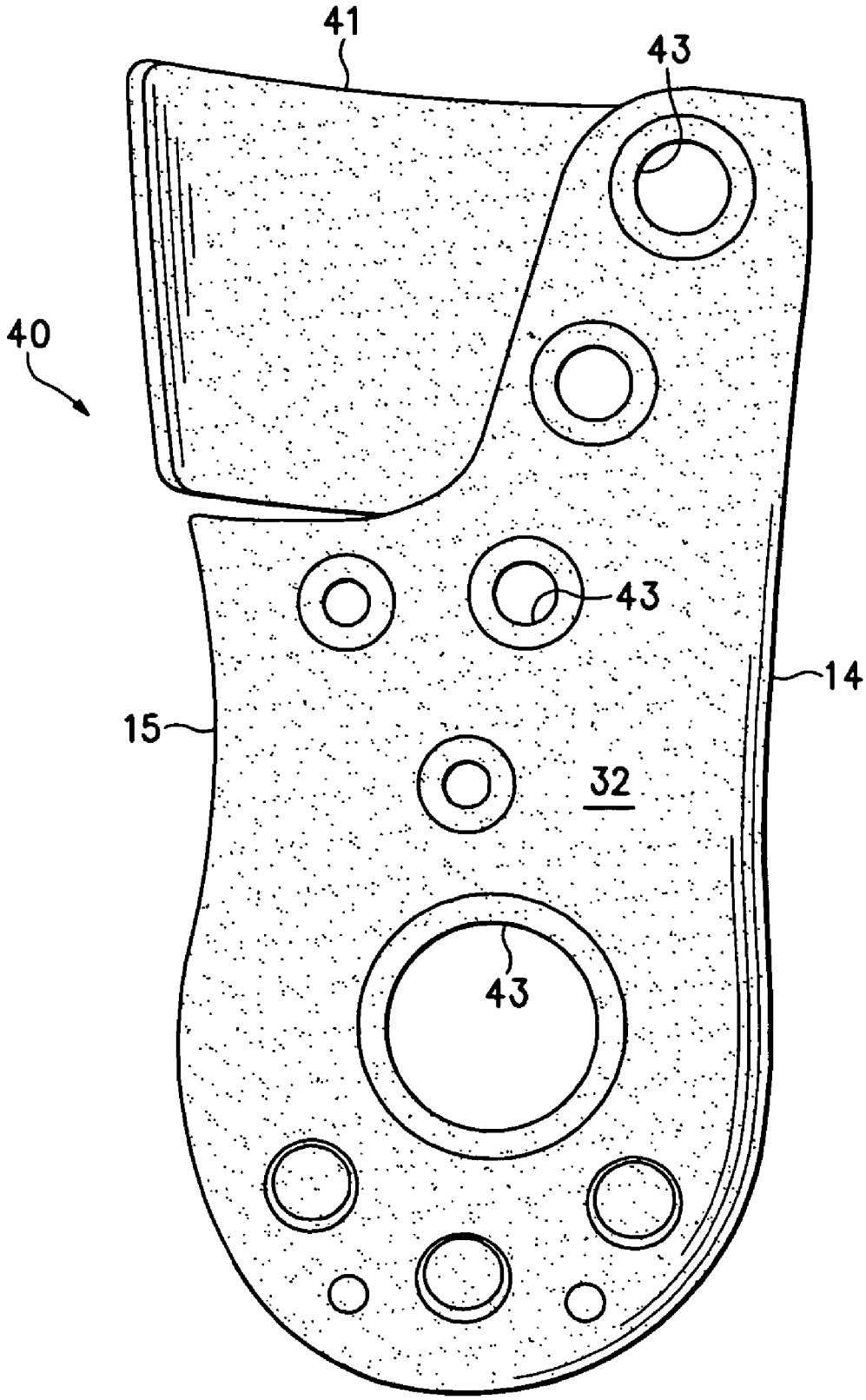
FIG. 9 is a bottom plan view of the first element.
Figure 10:
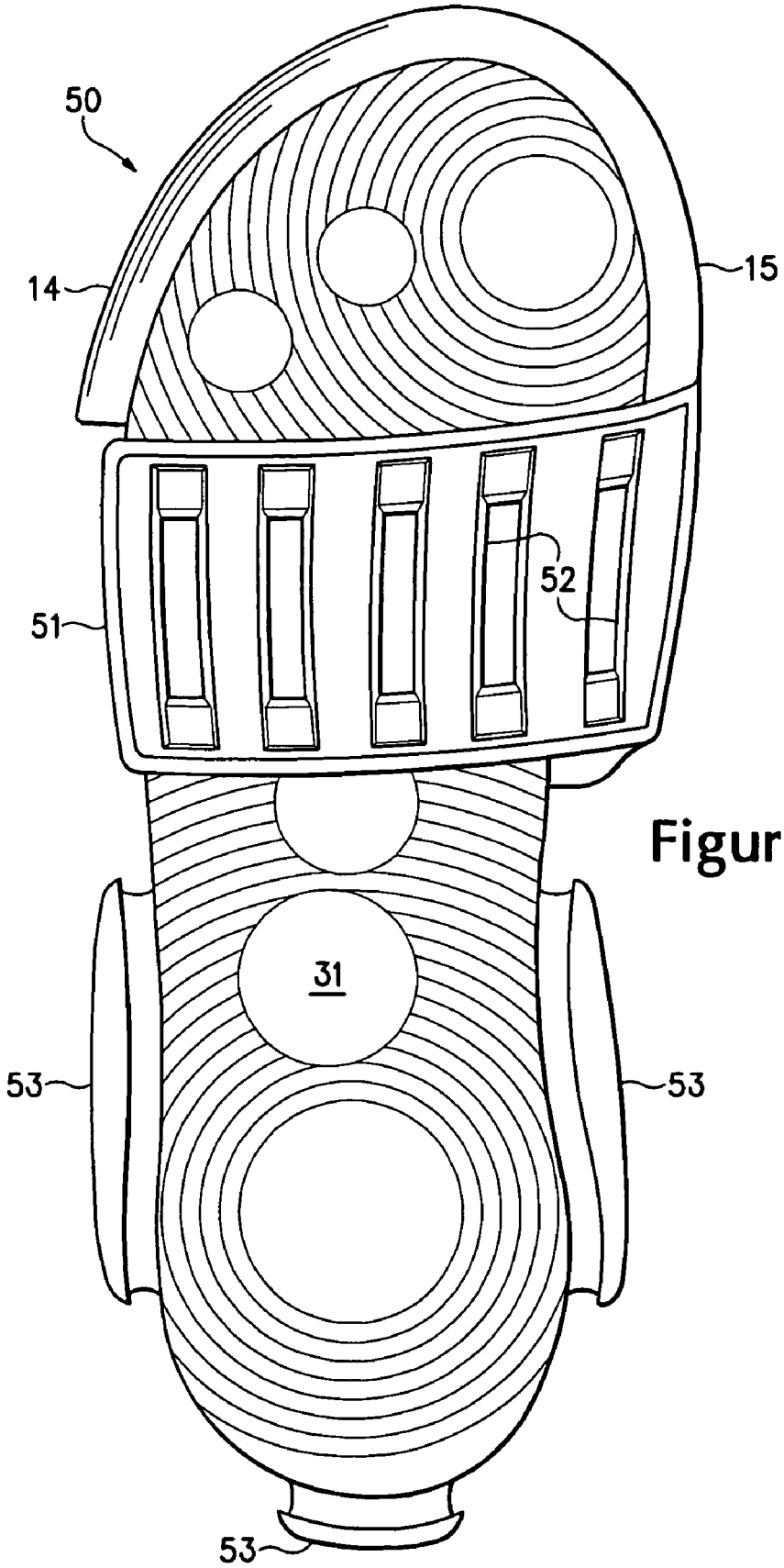
FIG. 10 is a top plan view of the second element.
Figure 11:
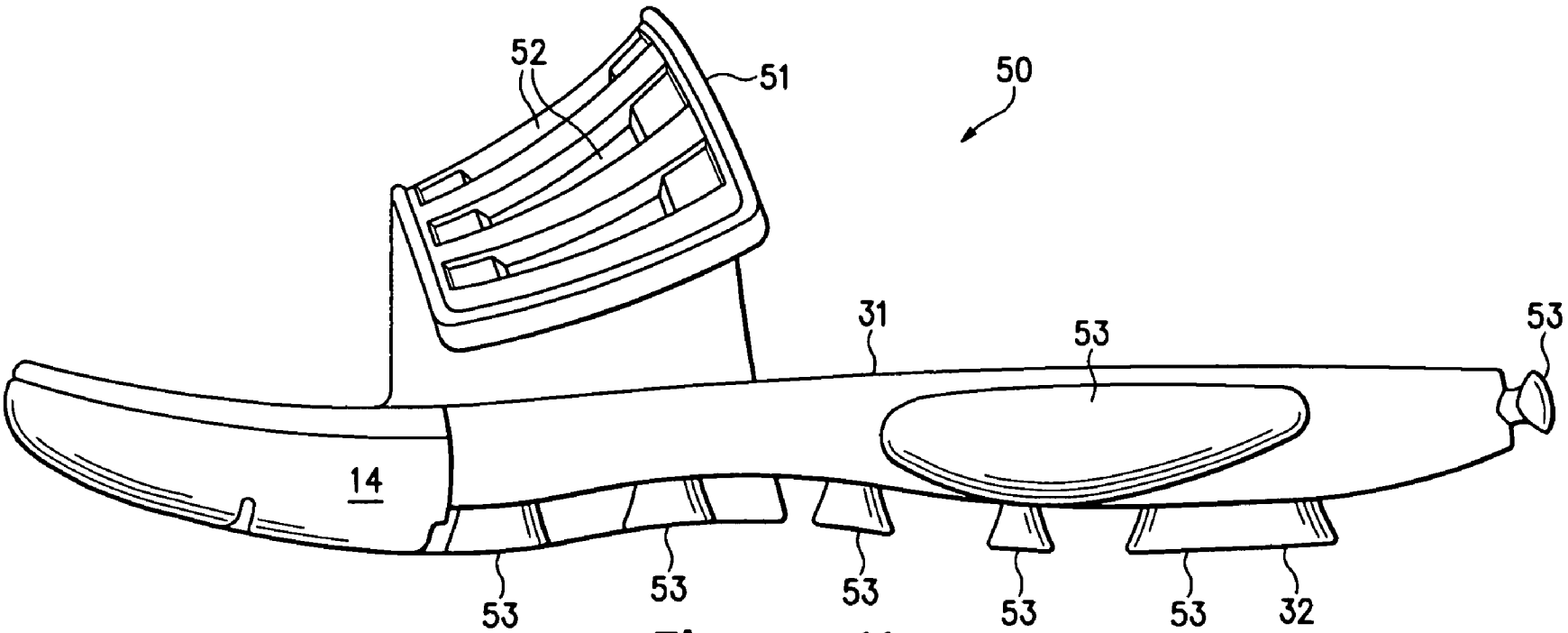
FIG. 11 is a lateral side elevational view of the second element.
Figure 12:
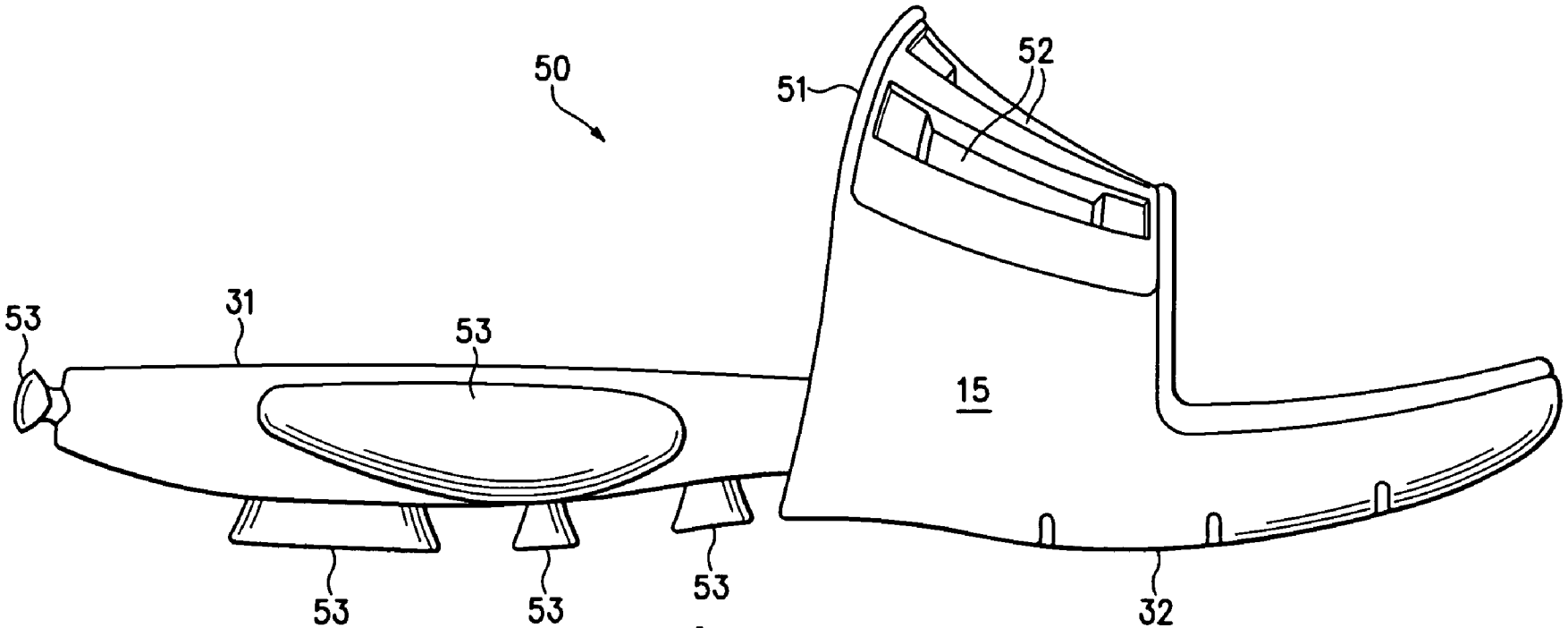
FIG. 12 is a medial side elevational view of the second element.
Figure 13:
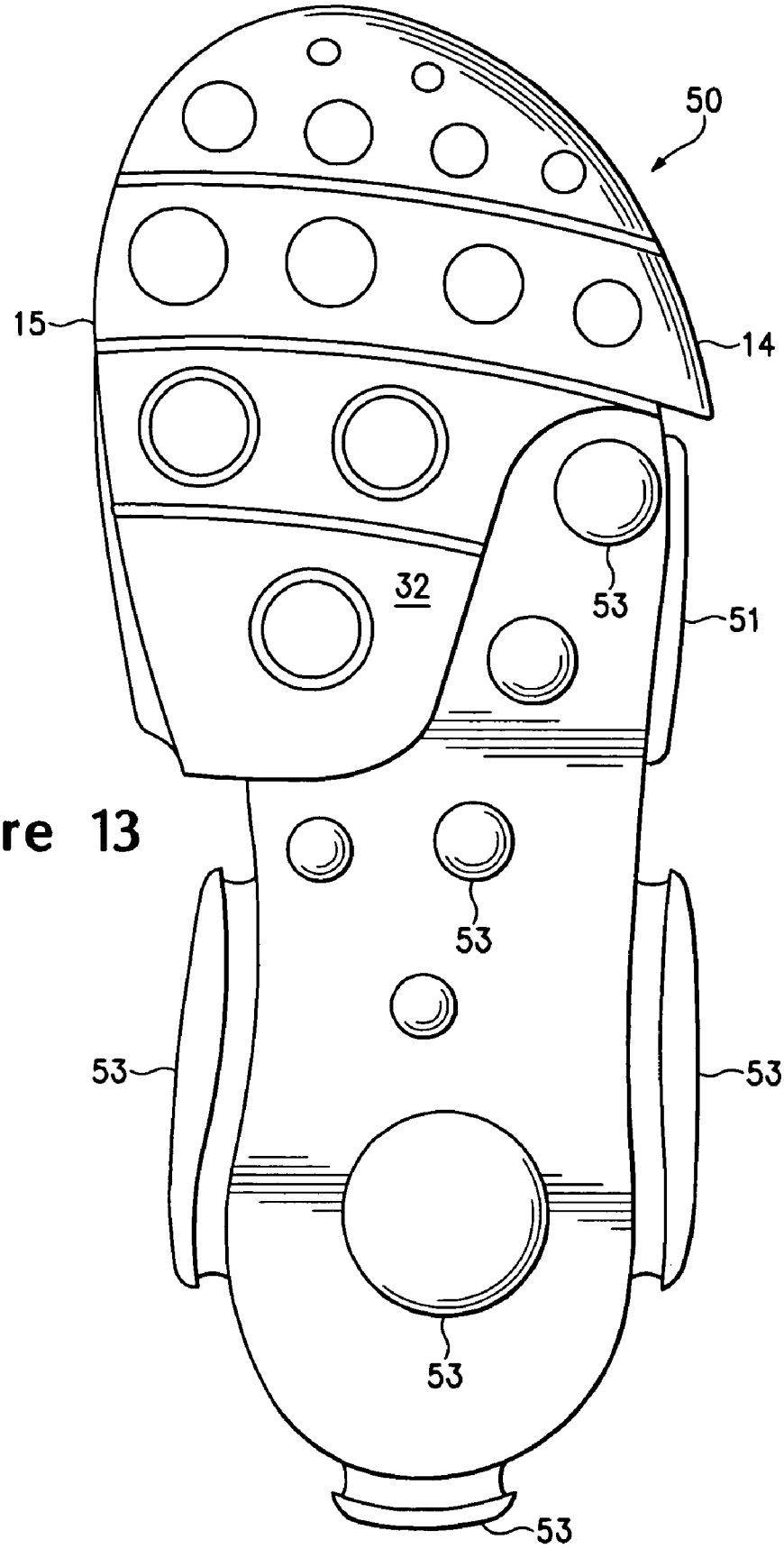
FIG. 13 is a bottom plan view of the second element.

The portions of protrusions 42 that are adjacent to a surface of first strap portion 41 have lesser dimensions than the portions of protrusions 42 that are further from surface of first strap portion 41, as depicted in the cross-sections of FIGS. 5A and 5E. That is, protrusions 42 mushroom or otherwise expand outward to form an indentation that extends at least partially around protrusions 42. When joined, apertures 52 extend into the indentations to form a secure and detachable snap-fit system between protrusions 42 and apertures 52.

With regard to sole structure 30, first element 40 and second element 50 interlock to form a structure for supporting the foot and engaging the ground. Whereas forefoot region 11 is primarily formed from second element 50, both of elements 40 and 50 form midfoot region 12 and heel region 13. More particularly, first element 40 has a concave configuration that receives a portion of second element 50 in midfoot region 12 and heel region 13. In order to join elements 40 and 50, a snap-fit system is utilized. That is, first element 40 defines a plurality of apertures 43 in areas corresponding with ground-engaging surface 32 and side surface 33, and second element 50 defines a plurality of protrusions 53 in corresponding locations. Accordingly, when second element 50 is placed within the concave area of first element 40, protrusions 53 may extend into apertures 43 to join elements 40 and 50, as depicted in the cross-sections of FIGS. 5B, 5D, and 5E. Similarly, elements 40 and 50 may be separated by removing protrusions 53 from apertures 43. As with protrusions 42, protrusions 53 may form an indentation that receives apertures 43 to form a secure and detachable snap-fit system between apertures 43 and protrusions 53.

Figure 2:
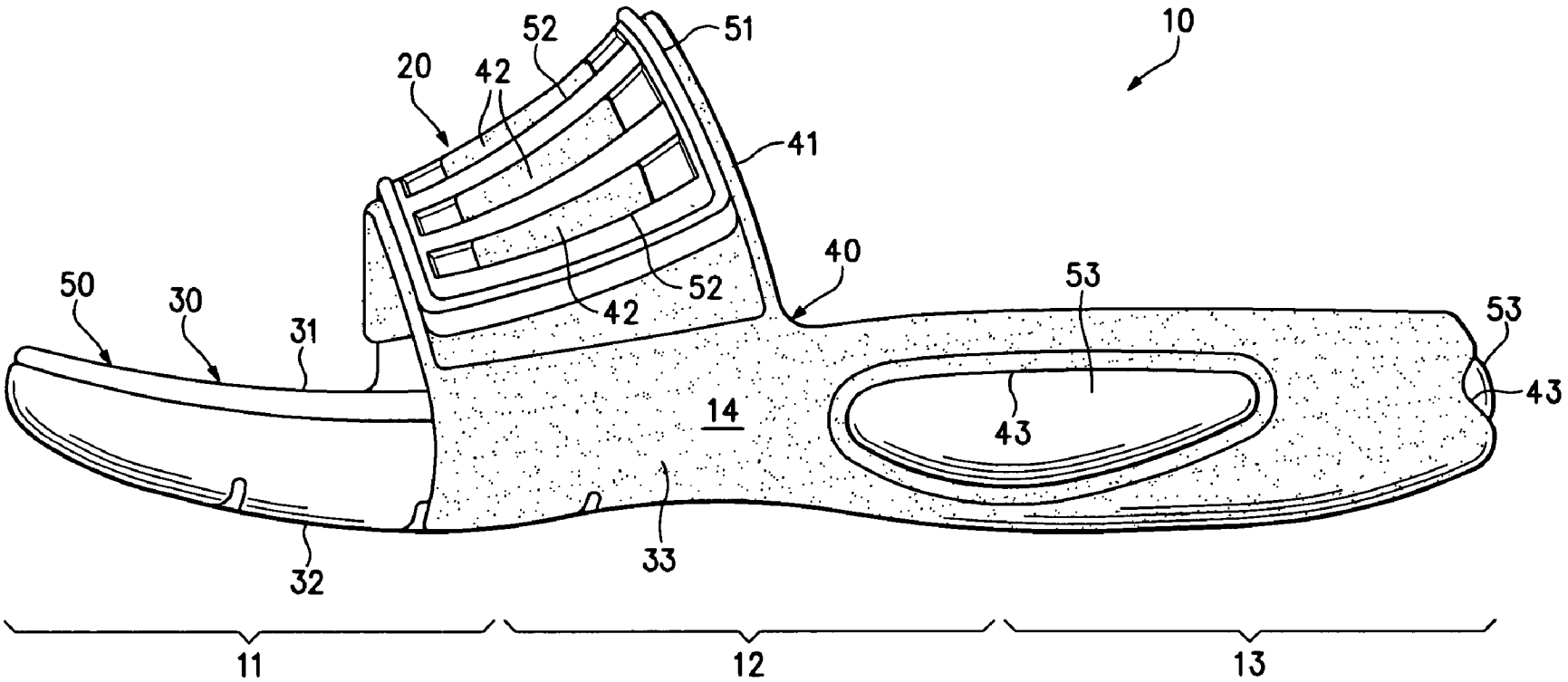
FIG. 2 is a lateral side elevational view of the footwear.
Figure 3:
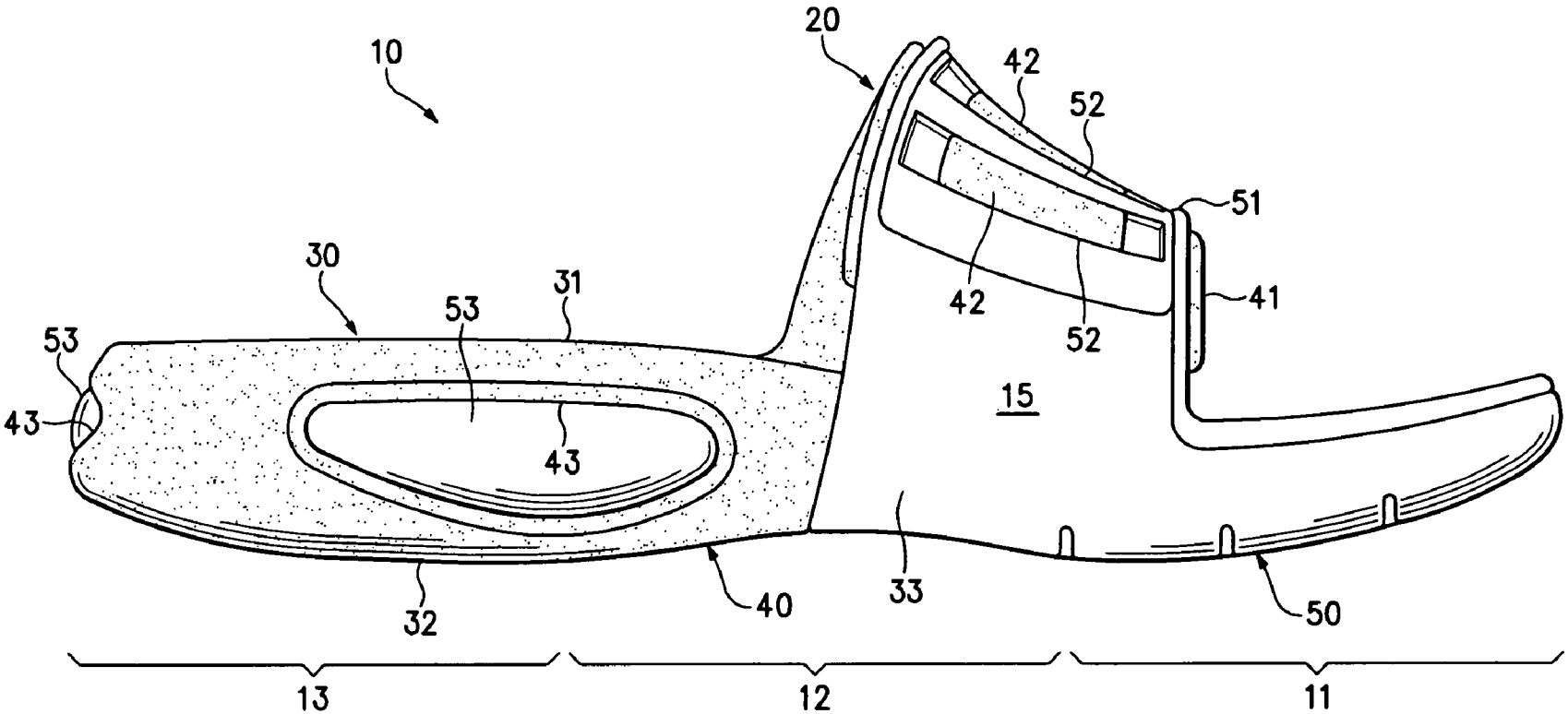
FIG. 3 is a medial side elevational view of the footwear.
Figure 4:
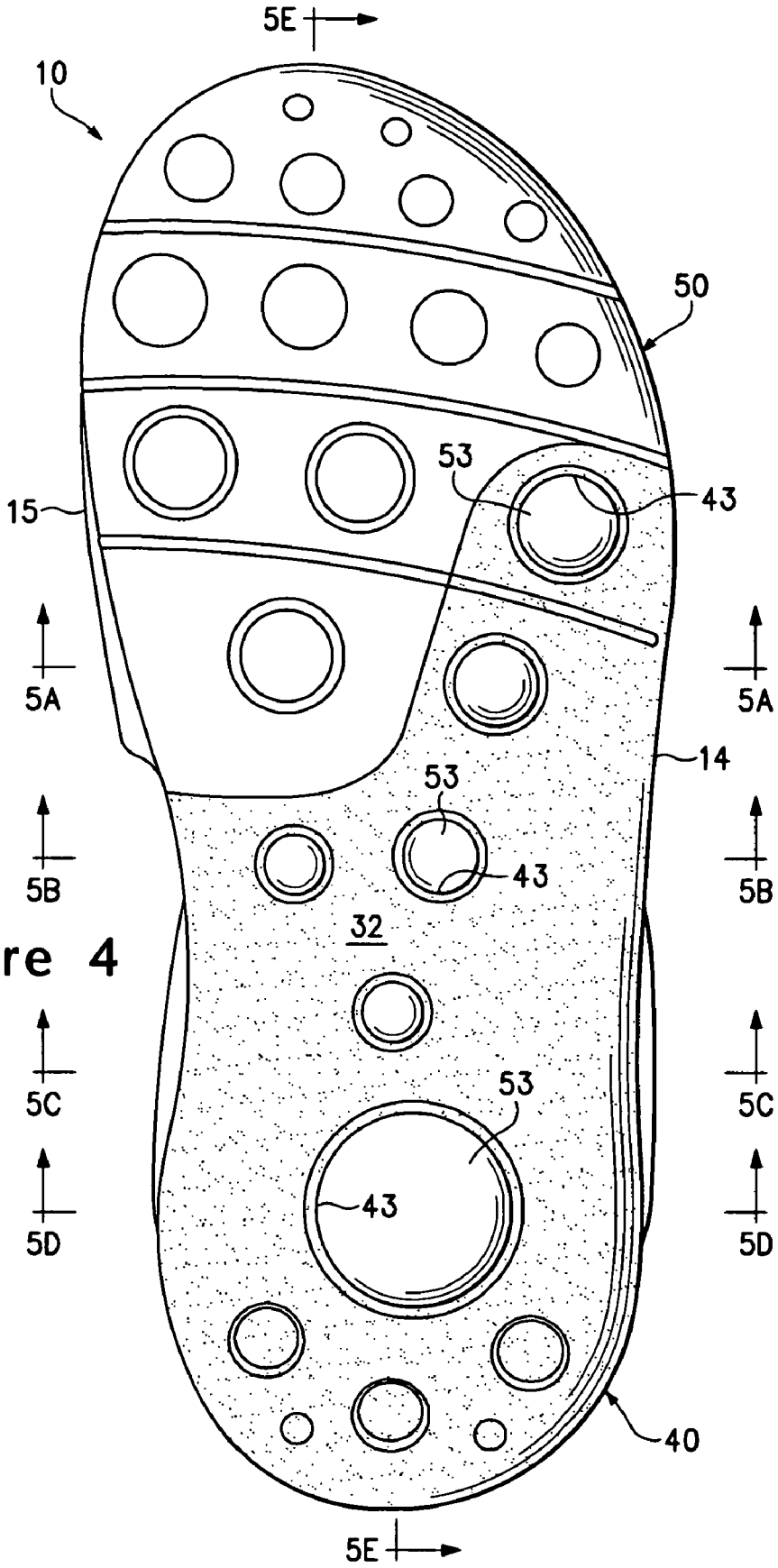
FIG. 4 is a bottom plan view of the footwear.

Elements 40 and 50 each form a portion of foot-supporting surface 31, ground-engaging surface 32, and side surface 33. Whereas second element 50 forms substantially all of foot-supporting surface 31 in forefoot region 11, first element 40 forms a peripheral area and second element 50 forms a central area of foot-supporting surface 31 in midfoot region 12 and heel region 13, as depicted in FIG. 1. Referring to FIG. 4, elements 40 and 50 each form a portion of ground-engaging surface 32. More particularly, first element 40 forms ground-engaging surface 32 in heel region 13 and the portion of ground-engaging surface 32 that is adjacent to lateral side 14 in midfoot region 12, but apertures 43 expose protrusions 53 in these areas. Similarly, second element 50 forms ground-engaging surface 32 in forefoot region 11 and the portion of ground-engaging surface 32 that is adjacent to medial side 15 in midfoot region 12. With regard to side surface 33, first element 40 primarily forms midfoot region 12 and heel region 13, whereas second element 50 primarily forms forefoot region 11. In heel region 13, however, the lower surfaces of protrusions 53 are exposed by apertures 43, as depicted in FIGS. 2 and 3.

Foot-supporting surface 31 may be contoured to conform with the anatomy of the foot. Elements 40 and 50 may, therefore, cooperatively form an arch support in midfoot region 12 and a depression in heel region 13 that receives the heel. As noted above, first element 40 forms a peripheral area and second element 50 forms a central area of foot-supporting surface 31 in midfoot region 12 and heel region 13. Accordingly, the peripheral area formed by first element 40 may be raised in relation to second element 50 in order to impart the depression in heel region 13. Similarly, elements 40 and 50 may be textured at ground-engaging surface 32 (e.g., with protrusions or indentations) to provide greater traction.

Suitable materials for elements 40 and 50 include a variety of polymer foam materials, such as polyurethane, ethylvinylacetate, and injected phylon. Flexible non-foam polymers, such as rubber and silicone, may also be utilized. In some configurations, elements 40 and 50 may be formed from the same material, or different materials may be utilized for each of elements 40 and 50. For example, first element 40 may be formed from a durable and wear-resistant material since first element 40 forms a majority of ground-engaging surface 32, and second element 50 may be formed from a softer material since second element 50 forms a majority of foot-supporting surface 31. Alternatively, rubber elements or other wear-resistant materials may also be bonded or otherwise incorporated into ground-engaging surface 32 to provide traction and greater durability. In some configurations, elements 40 and 50 may also be formed from materials with different colors to enhance the aesthetic qualities of footwear 10. Although the snap-fit system discussed above is suitable for joining elements 40 and 50, adhesives or other fasteners may also be utilized. Accordingly, a variety of materials and material combinations may be utilized for footwear 10.

Footwear 10 is disclosed as having the configuration of a sandal. In further configurations, footwear 10 may be a clog if elements 40 and 50 are modified to extend over the toe area of the foot. Similarly, by modifying elements 40 and 50 to extend around the heel area of the foot, footwear 10 may also have the configuration of a shoe. Although footwear 10 is depicted as having only elements 40 and 50, additional elements may also be added. That is, three or more elements may cooperatively form upper 20 and sole structure 30. The specific configuration of footwear 10 may, therefore, depart significantly from the exemplar configuration depicted in the figures.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of footwear having an upper with a configuration of a strap extending across a midfoot region of a foot and extending from a lateral side to a medial side of the article of footwear; and a sole structure, the footwear comprising two joinable and detachable polymer foam elements that each form a portion of the upper and the sole structure, wherein a first of the foam elements defines a plurality of protrusions, and a second of the foam elements defines a plurality of apertures, the protrusions joining with the apertures to secure the foam elements together, wherein a portion of the protrusions and apertures are located at a side surface of the sole structure.

2. The article of footwear recited in claim 1, wherein the upper includes two strap portions, and each of the foam elements form one of the strap portions.

3. The article of footwear recited in claim 2, wherein a first of the strap portions defines a plurality of protrusions, and a second of the strap portions defines a plurality of apertures, the protrusions joining with the apertures to secure the strap portions together.

4. The article of footwear recited in claim 1, wherein the sole structure has a foot-engaging surface and an opposite ground-engaging surface, and each of the foam elements form different areas of the foot-engaging surface and the ground-engaging surface.

5. The article of footwear recited in claim 1, wherein a portion of the protrusions and apertures are located at a ground-engaging surface of the sole structure.

6. The article of footwear recited in claim 1, wherein the foam elements have different colors.

7. An article of footwear having an upper with a configuration of a strap extending across a midfoot region of a foot and extending from a lateral side to a medial side of the article of footwear; and a sole structure, the footwear comprising two joinable and detachable polymer foam elements that each form a portion of the upper and the sole structure, wherein the article of footwear includes a third foam element, and one of the foam elements is interchangeable with the third foam element.

8. An article of footwear having an upper with a configuration of a strap and a sole structure, the footwear comprising two joinable and detachable polymer foam elements that each form (a) one of two portions of the strap and (b) different portions of the sole structure, wherein a first of the foam elements defines a plurality of protrusions, and a second of the foam elements defines a plurality of apertures, the protrusions joining with the apertures to secure the foam elements together, wherein a portion of the protrusions and apertures are located at a side surface of the sole structure.

9. The article of footwear recited in claim 8, wherein a first of the portions of the strap defines a plurality of protrusions, and a second of the portions of the strap defines a plurality of apertures, the protrusions joining with the apertures to secure the strap portions together.

10. The article of footwear recited in claim 8, wherein the sole structure has a foot-engaging surface and an opposite ground-engaging surface, and each of the foam elements form different areas of the foot-engaging surface and the ground-engaging surface.

11. The article of footwear recited in claim 8, wherein a portion of the protrusions and apertures are located at a ground-engaging surface of the sole structure.

12. The article of footwear recited in claim 8, wherein the foam elements have different colors.

13. The article of footwear recited in claim 8, wherein the article of footwear includes a third foam element, and one of the foam elements is interchangeable with the third foam element.

14. An article of footwear comprising:

an upper having a configuration of a strap that includes two joinable and detachable strap portions; and a sole structure secured to the upper, the sole structure having a foot-engaging surface and an opposite ground-engaging surface, each of the upper and the sole structure being partially formed from two foam elements, each of the two foam elements forming (a) one of the strap portions, (b) a portion of the foot-engaging surface, and (c) a portion of the ground-engaging surface.

15. The article of footwear recited in claim 14, wherein a first of the strap portions defines a plurality of protrusions, and a second of the strap portions defines a plurality of apertures, the protrusions joining with the apertures to secure the strap portions together.

16. The article of footwear recited in claim 14, wherein a first of the foam elements defines a plurality of protrusions, and a second of the foam elements defines a plurality of apertures, the protrusions joining with the apertures to secure the foam elements together.

17. An article of footwear comprising:

an upper having a configuration of a strap that includes two joinable and detachable strap portions; and a sole structure secured to the upper, the sole structure having a foot-engaging surface and an opposite ground-engaging surface, each of the upper and the sole structure being partially formed from two foam elements, each of the two foam elements forming (a) one of the strap portions, (b) a portion of the foot-engaging surface, and (c) a portion of the ground-engaging surface;

wherein a first of the foam elements defines a plurality of protrusions, and a second of the foam elements defines a plurality of apertures, the protrusions joining with the apertures to secure the foam elements together; and wherein a first portion of the protrusions and apertures are located at a side surface of the sole structure, and a second portion of the protrusions and apertures are located at the ground-engaging surface.

18. The article of footwear recited in claim 14, wherein the foam elements have different colors.

19. The article of footwear recited in claim 14, wherein the article of footwear includes a third foam element, and one of the foam elements is interchangeable with the third foam element.

20. An article of footwear having an upper and a sole structure, the footwear comprising:

a first foam element that forms a first strap portion of the upper and at least a first portion of each of a foot-engaging surface and an opposite ground-engaging surface of the sole structure; and a second foam element that is joinable to and detachable from the first foam element, the second foam element forming a second strap portion of the upper and at least a second portion of each of the foot-engaging surface and the ground-engaging surface of the sole structure, wherein the first foam element defines a plurality of protrusions, and the second foam element defines a plurality of apertures, the protrusions joining with the apertures to join the foam elements together; and wherein a portion of the protrusions and apertures are located at a side surface of the sole structure.

21. The article of footwear recited in claim 20, wherein a portion of the protrusions and apertures are located at the ground-engaging surface.

22. The article of footwear recited in claim 20, wherein the first strap portion defines a plurality of protrusions, and the second strap portion defines a plurality of apertures, the protrusions joining with the apertures to secure the first strap portion and second strap portion together.

23. The article of footwear recited in claim 20, wherein the foam elements have different colors.

24. The article of footwear recited in claim 20, wherein the article of footwear includes a third foam element, and one of the first foam element and the second foam element is interchangeable with the third foam element.

* * * * *

UNITED STATES PATENT AND TRADEMARK OFFICE

CERTIFICATE OF CORRECTION

PATENT NO. : 7,644,517 B2
APPLICATION NO. : 11/455271
DATED : January 12, 2010
INVENTOR(S) : Marni L. Gerber It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 769 days.

Signed and Sealed this

Sixteenth Day of November, 2010

David J. Kappos

David J. Kappos
*Director of the United States Patent and Trademark Office*